US011441362B2

(12) United States Patent
Deiters et al.

(10) Patent No.: US 11,441,362 B2
(45) Date of Patent: Sep. 13, 2022

(54) GUIDING SLEEVE FOR ALIGNING DOWNHOLE TUBULARS

(71) Applicants: Arne Deiters, Saxony (DE); Matthias Gatzen, Isernhagen (DE); Daniel Porzig, Lower Saxony (DE); Andreas Peter, Celle Niedersachsen (DE); Michael Gasch, Lower Saxony (DE)

(72) Inventors: Arne Deiters, Saxony (DE); Matthias Gatzen, Isernhagen (DE); Daniel Porzig, Lower Saxony (DE); Andreas Peter, Celle Niedersachsen (DE); Michael Gasch, Lower Saxony (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/719,503

(22) Filed: Dec. 18, 2019

(65) Prior Publication Data

US 2020/0190921 A1 Jun. 18, 2020

Related U.S. Application Data

(60) Provisional application No. 62/781,464, filed on Dec. 18, 2018.

(51) Int. Cl.

| | |
|---|---|
| ***E21B 17/02*** | (2006.01) |
| ***E21B 17/042*** | (2006.01) |
| ***E21B 19/24*** | (2006.01) |

(52) U.S. Cl.

CPC ..... *E21B 17/028* (2013.01); *E21B 17/042* (2013.01); *E21B 19/24* (2013.01)

(58) Field of Classification Search

CPC ..... E21B 19/24; E21B 17/028; E21B 17/042

See application file for complete search history.

(56) References Cited

U.S. PATENT DOCUMENTS

| | | | | |
|---|---|---|---|---|
| 5,137,310 | A | 8/1992 | Noel et al. | |
| 5,964,486 | A | 10/1999 | Sinclair | |
| 7,694,753 | B2 | 4/2010 | Carlson et al. | |
| 2001/0030047 | A1 | 10/2001 | Chau et al. | |
| 2002/0033603 | A1 | 3/2002 | Pallini et al. | |
| 2005/0016769 | A1* | 1/2005 | Wallace | E21B 17/028 175/40 |
| 2005/0103527 | A1 | 5/2005 | Church et al. | |

(Continued)

FOREIGN PATENT DOCUMENTS

| | | | |
|---|---|---|---|
| CN | 201087728 | Y | 7/2008 |

OTHER PUBLICATIONS

International Search Report and Written Opinion for International Application No. PCT/US2019/063343; International Filing Date Nov. 26, 2019; dated Mar. 18, 2020 (pp. 1-9).

(Continued)

*Primary Examiner* — Dany E Akakpo

(74) *Attorney, Agent, or Firm* — Cantor Colburn LLP

(57) ABSTRACT

A guiding sleeve for aligning downhole tubulars includes a body having a first end portion, a second end portion and an intermediate portion extending therebetween. The first end portion is receptive of a terminal end of a first tubular and the second end portion includes a guiding feature that promotes axial alignment of the first tubular with a second tubular.

20 Claims, 5 Drawing Sheets

(56) References Cited

U.S. PATENT DOCUMENTS

| | | | | |
|---|---|---|---|---|
| 2007/0023190 | A1* | 2/2007 | Hall | E21B 43/08 166/350 |
| 2008/0251247 | A1* | 10/2008 | Flint | E21B 17/006 166/65.1 |
| 2015/0145247 | A1 | 5/2015 | Zhu et al. | |
| 2015/0184494 | A1* | 7/2015 | Vestavik | E21B 19/16 166/382 |
| 2018/0051525 | A1 | 2/2018 | Slaughter, Jr. et al. | |
| 2018/0106114 | A1 | 4/2018 | Shampine et al. | |

OTHER PUBLICATIONS

International Search Report and Written Opinion for International Application No. PCT/US2019/067214; International Filing Date Dec. 18, 2019; dated Apr. 23, 2020 (pp. 1-9).

* cited by examiner

GUIDING SLEEVE FOR ALIGNING DOWNHOLE TUBULARS

CROSS REFERENCE TO RELATED APPLICATIONS

This application claims the benefit of an earlier filing date from U.S. Provisional Application Ser. No. 62/781,464 filed Dec. 18, 2018, the entire disclosure of which is incorporated herein by reference.

BACKGROUND

In the resource exploration and recovery industry, a borehole is formed in a formation to provide access to one or more resource bearing zones. The borehole may be formed by a drill connected to a drill string made up of a number of tubulars. Once formed, a tubular string formed from any number of tubulars may be guided into the borehole for the purpose of testing and extracting formation fluids. Each tubular includes a pin or externally threaded end and a box or internally threaded end. The pin end of one tubular is threaded into a box end of another tubular to make up a joint. It is desirable that the tubulars are axially aligned while being joined to ensure a proper makeup of the joint. Misalignments may lead to thread damage, poor sealing as well as other issues.

In some cases, tubulars may include conduits, such as electrical conductors, hydraulic conductors and the like that are joined when making up a joint. Each tubular will support a connector portion. When making up a joint that includes a connector, axial alignment is desirable in order to ensure a proper connection. When connectors are arranged centrally within the tubular, proper alignment reduces stress and improves signal clarity. Therefore, the art would appreciate a system that enhances axial alignment of tubulars dun connection process.

SUMMARY

Disclosed is a guiding sleeve for aligning downhole tubulars including a body having a first end portion, a second end portion and an intermediate portion extending therebetween. The first end portion is receptive of a terminal end of a first tubular and the second end portion includes a guiding feature that promotes axial alignment of the first tubular with a second tubular.

Also disclosed is a system of tubulars including a first tubular having a first terminal end, a second tubular having a second terminal end, and a guiding sleeve connected to the first tubular. The guiding sleeve includes a body having a first end portion, a second end portion and an intermediate portion extending therebetween. The first end portion is connected to the first terminal end. The second end portion includes a guiding feature that promotes axial alignment of the first tubular with the second tubular.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
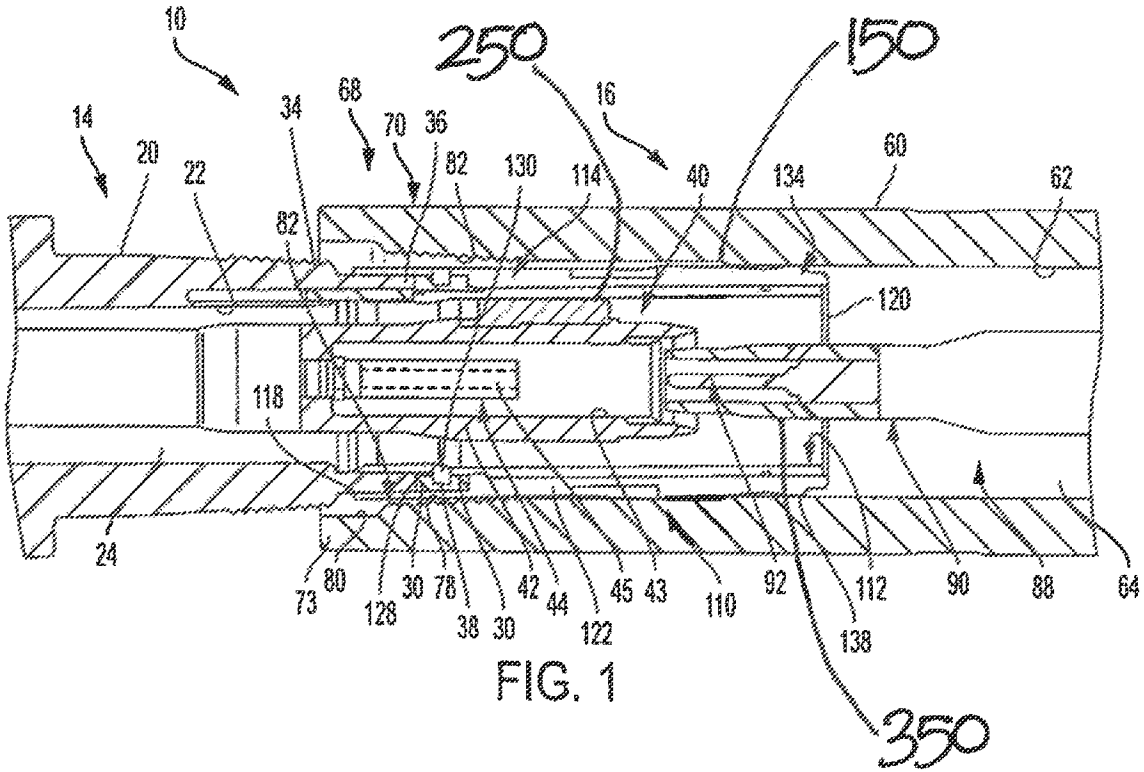
FIG. 1 depicts a system of tubulars including a first tubular being connected with a second tubular axially aligned by a guiding sleeve, in accordance with an aspect of an exemplary embodiment.

A system of tubulars, in accordance with an aspect of an exemplary embodiment, is illustrated generally at 10 in FIG. 1. System of tubulars 10 includes a first tubular 14 and a second tubular 16. First tubular 14 includes an outer surface 20 and an inner surface 22 that defines a first interior 24. First tubular 14 includes a first terminal end 30 that defines a pin end (not separately labeled) having an externally threaded portion 34 and an external unthreaded portion 36. A recess 38 may be provided in unthreaded portion 36. In one embodiment, the first tubular and the second tubular are part of a bottom hole assembly (BHA).

In an embodiment, first tubular 14 supports a first connector system 40 arranged centrally in first interior 24. First connector system 40 includes a guide member 42 having an inner wall 43 that extends about a first connector portion 44. First connector portion 44 includes a central recess 45. First connector portion 44 may support a conductor (not shown) that delivers a control signal to first connector system 40. The control signal may take on various forms including electrical current, optical signals, hydraulic signals and the like. In an embodiment, first connector portion 44 may define one of a first electrical connector portion, a first hydraulic connector portion, and a first optical connector portion.

In further accordance with an exemplary embodiment, second tubular 16 includes an outer surface 60 and an inner surface 62 that defines a second interior 64. Second tubular 16 includes a second terminal end 68 that devices a box end 70 having an outer edge 73. An angled back bore 78 extends axially along second interior 64. Angled back bore 78 extends at an angle that increases radially inwardly from about outer edge 73 axially along second interior 64. A chamfer region 80 may be formed between outer edge 73 and angled back bore 78. Chamfer region 80 promotes an initial alignment of first terminal end 30 relative to second terminal end 68. A portion of angled back bore 78 may define an internally threaded section 82. A chamfer region 150 is formed on the inner surface 62 of the second tubular. The chamfer region 150 relates to an inner diameter decrease of the back bore of the second tubular, that extends axially along the second tubular radially inwards.

In an embodiment, second tubular 16 supports a second connector system 88 arranged centrally in second interior 64. Second connector system 88 is configured to mate with first connector system, 40 for the purpose of passing a signal through first tubular 14 into second tubular 16 or vice versa. As discussed herein, the signal may be an electrical signal, a hydraulic signal, an optical signal or the like. Second connector system 88 includes a second connector portion 90 that supports a connector 92 coupled to a conductor (not shown). Connector 92 is received by central recess 45 when first tubular 14 is joined with second tubular 16 as will be detailed herein. In an embodiment, second connector portion 90 may define one of a second electrical connector portion, a second hydraulic connector portion, and a second optical connector portion.

In a further embodiment, the electrical connection between the first electrical connector portion and the second electrical connector portion may transmit power, data, or power and data simultaneously.

Non-limiting examples of a second connector system 88 mated with a first connector system 40 include two rings contacted together, or a pin-ring combination. In another embodiment, one portion of the connector can be a male pin member having multiple electrical contacts axially separated along its body, while the other portion of the connector comprises a female member having multiple corresponding electrical contacts, into which the male pin member is inserted. One or more O-rings may be arranged with the outer housing 350 of the second connector portion 90.

The present invention may be utilized to protect any delicate mechanical structure within a first and/or second tubular. In further embodiments, the first and second connector systems 40, 88 may be absent. For example, the present invention may be use to protect a fluid line only.

In still further accordance with an exemplary aspect, a guiding sleeve 110 is coupled to first terminal end 30. Guiding sleeve 110 includes a first or inner guiding member 112 and a second or outer guiding member 114. While shown as being two components, guiding sleeve 110 may be formed as a single, unitary member. In one embodiment, guiding sleeve 110 is not joined to the first connector portion 40 by support member 250. Guiding sleeve 110 includes a body (not separately labeled) having a first end portion 118, a second end portion 120 and an intermediate portion 122 extending therebetween. An annular recess 128 may be formed at first end portion 118 between inner guiding member 112 and outer guiding member 114. Annular recess 128 may be receptive of unthreaded portion 39 of first terminal end 30. A mechanical fastener 130 may extend through outer guiding member 114 into recess 38 to secure guiding sleeve 110 to first terminal end 30. Guiding sleeve 110 is arranged axially outward of the externally threaded portion 34 in the pin end of the first terminal end 30 of the first tubular 14.

In yet still further accordance with an exemplary aspect, guiding sleeve 110 includes a guiding feature 134 at second end portion 120. Guiding feature 134 may take the form of an annular projection 138 that extends entirely about, or about a portion of second end portion 120. In an embodiment, guiding feature 134 may include a generally rounded cross-section 140. It should be understood that guiding feature 134 may take on various forms and/or geometries. It should also be understood that guiding feature 134 may constitute a geometric attribute of guiding sleeve 110.

Guiding sleeve 110 may be formed from a material that is softer than the materials employed in the formation of the second tubular 16. That is, guiding sleeve 110 is formed from a material having a hardness that is less than a hardness of the second tubular 16. For example, guiding sleeve 110 may be formed from bronze, copper alloys, or other similar materials. The use of a softer material reduces frozen connections that might occur if guiding sleeve 110 were formed from a material having a hardness similar to that used to form the second tubular 16, and also minimizes damage to the pin- and box-end threads. In an embodiment, outer guiding member 114 may be formed from a first material and inner guiding member 112 may be formed from a second material that may be distinct from the first material. Inner guiding member 112 may be formed from a material that is non-electrically conductive.

In accordance with an exemplary embodiment, guiding sleeve 110 promotes an axial alignment of first tubular 14 relative to second tubular 16. The axial alignment improves a connection between pin end 32 and box end 70. Specifically, ensuring good axial alignment reduces cross-threading issues or other connection problems that may lead to faulty sealing between first and second tubulars 14 and 16. Guiding sleeve 110 allows for a first selected axial misalignment between first and second tubulars 14 and 16 as shown in FIG. 1. The first selected axial alignment accommodates an initial insertion of pin end 32 into box end 70. Guiding feature 134 encourages at least two points of contact (not separately labeled) between guiding sleeve 110 and an inner surface 62 of the second tubular 16. During the alignment process, at least two points of contact are established between the guiding sleeve 110 and an inner surface 62 of the second tubular 16. A first point of contact is between the guiding feature 134 (proximate to the terminal end of the guiding sleeve 110) and the inner surface 62 of the second tubular 16. A second point of contact is between the guiding sleeve 110 and the inner surface 62 of the second tubular 16 at a position on the guiding sleeve 110 that is distal axially to the first point of contact, i.e. the second point of contact is on the sleeve section of the guiding sleeve 110. The sleeve section refers to the intermediate portion of the guiding sleeve 110 that extends between its first and second end portions.

In one stage of the alignment process, the guiding sleeve 110 is moved axially along the inner surface 62 of the second tubular 16 causing the guiding feature 134 to pass the chamfer region 150 that is formed on the inner surface 62.

During the alignment process, the axial distance between the first point of contact and the second point of contact varies. For example, in another stage of the alignment process, when approaching a certain level of alignment, and the guiding sleeve has further passed the chamfer region 150, the second point of contact is located at the chamfer region 150 and does not deviate from that position, although the second point of contact moves relative to the guiding sleeve. However, because the guiding sleeve is still moving axially at this stage, the first point of contact (guiding feature at inner surface) is moving axially away from the chamfer region 150, and so the axial distance between the first point of contact and the second point of contact increases. The axial distance is the distance between the first and second points of contact along the longitudinal axis of the guiding sleeve 110.

A defined first point of contact at the guiding feature and a second point of contact distal from the terminal end of the guiding sleeve limit a maximum misalignment. When full alignment is approached, the second point of contact moves on the sleeve section of the guiding sleeve. When full alignment is achieved, the second point of contact is located at the chamfer region 150, as previously discussed.

Figure 5:
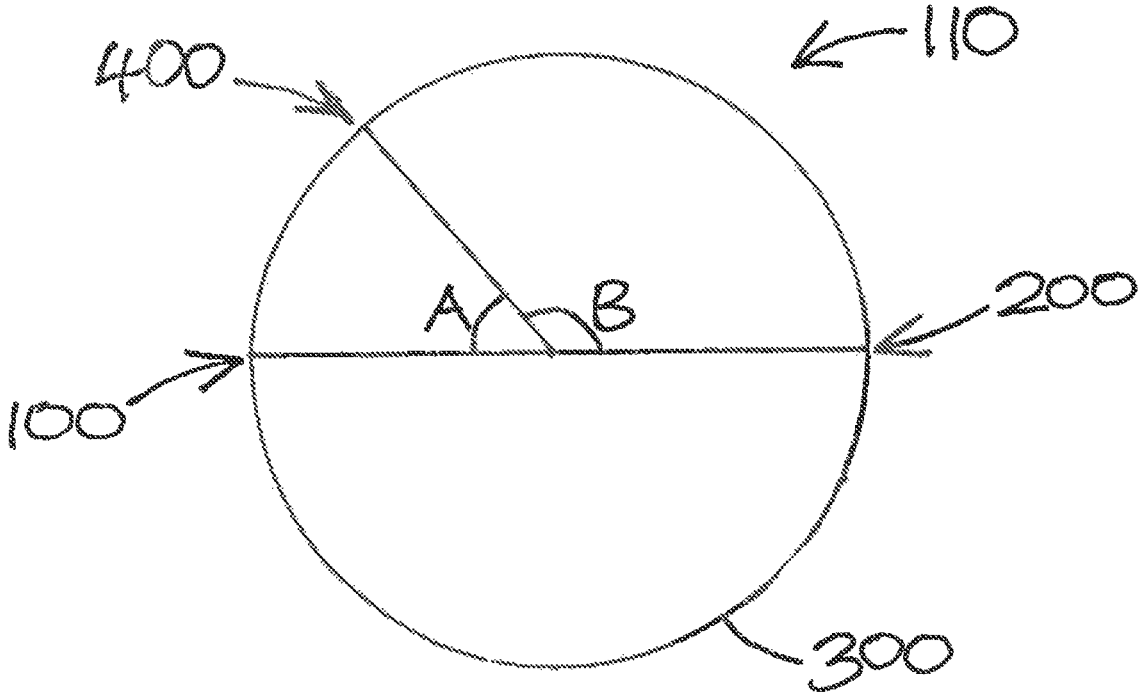
FIG. 5 depicts a schematic cross section of the guiding sleeve illustrating points of contact and angles therebetween.

However, throughout the alignment process, when the guiding sleeve 110 is taken in transverse cross section to its longitudinal axis, the angle between the two points of contact along the circumference of the guiding sleeve 110 remains at 180 degrees (from the longitudinal axis of the guiding sleeve 110). FIG. 5 illustrates such a cross section of the guiding sleeve 110, and defines the angular position of the first point of contact 100 (guiding feature) and the second point of contact 200 (guiding sleeve). The first and second points of contact 100, 200 are indicated on the circumference 300 of the guiding sleeve. A reference point 400 is shown on the circumference 300. A first angle A exists between the first point of contact 100 and the reference point 400. A second angle B exists between the second point of contact 200 and the reference point 400. The sum of angle A and angle B is 180 degrees. For example, if angle A is 40 degrees, then angle B is 140 degrees. Therefore, the angle (difference angle) between the first point of contact 100 and the second point of contact 200 along the circumference 300 in a cross section perpendicular to the longitudinal axis of the guiding sleeve 110 is always 180 degrees.

Figure 2:
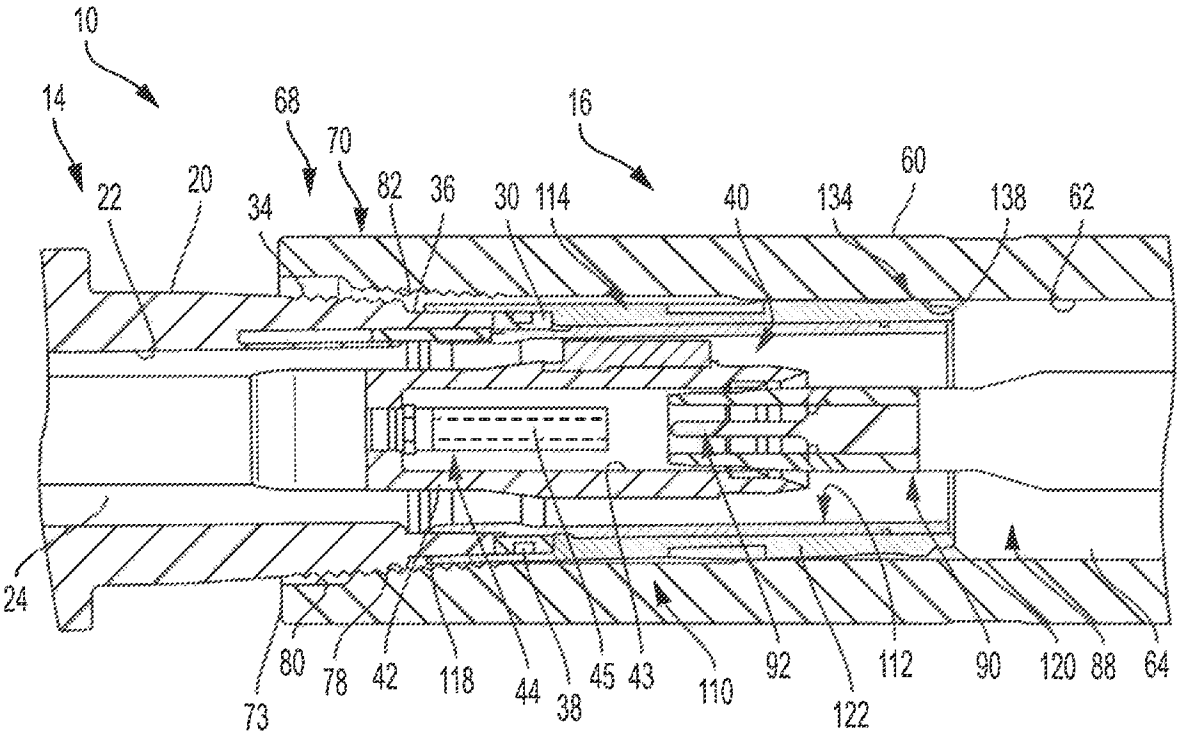
FIG. 2 depicts the system of tubulars of FIG. 1 illustrating the guiding sleeve further axially aligning the first tubular relative to the second tubular, in accordance with an aspect of an exemplary embodiment.

As pin end 32 moves into box end 70 the selected amount of axial misalignment is reduced as shown in FIG. 2. For example, guiding feature 134 may allow no more than about 8-degrees of misalignment initially. However, as first terminal end 30 is moved into second terminal end 68, the selected amount of misalignment may be reduced to no more than about 5-degrees. Guiding feature 134 continues to promote at least two points of contact between guiding sleeve 110 and inner surface 62. In this manner, guiding sleeve 110 aligns externally threaded portion 34 of pin end 32 with internally threaded section 82 of box end 70 to promote a proper joint make up. At the same time, guiding sleeve 110 promotes alignment of first connector system 40 with second connector system 88.

Figure 3:
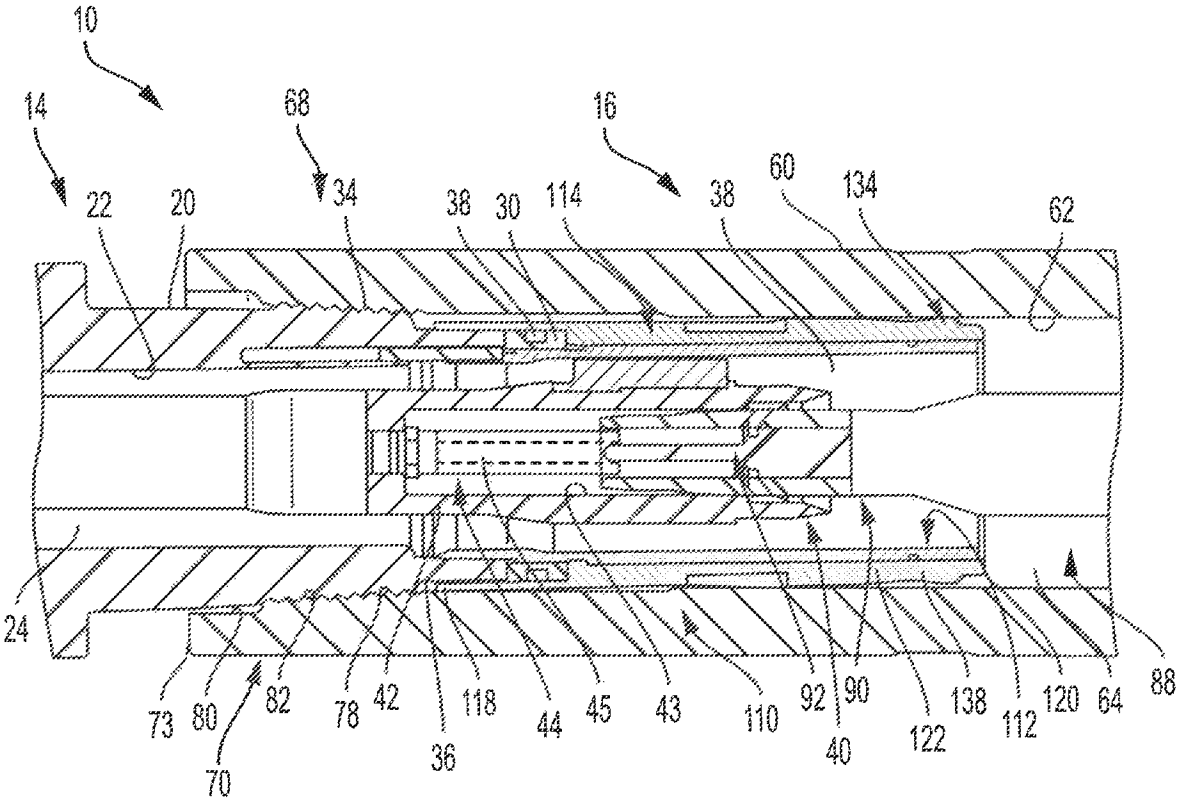
FIG. 3 depicts the system of tubulars of FIG. 2 illustrating the guiding sleeve still further axially aligning the first tubular relative to the second tubular, in accordance with an aspect of an exemplary embodiment.
Figure 4:
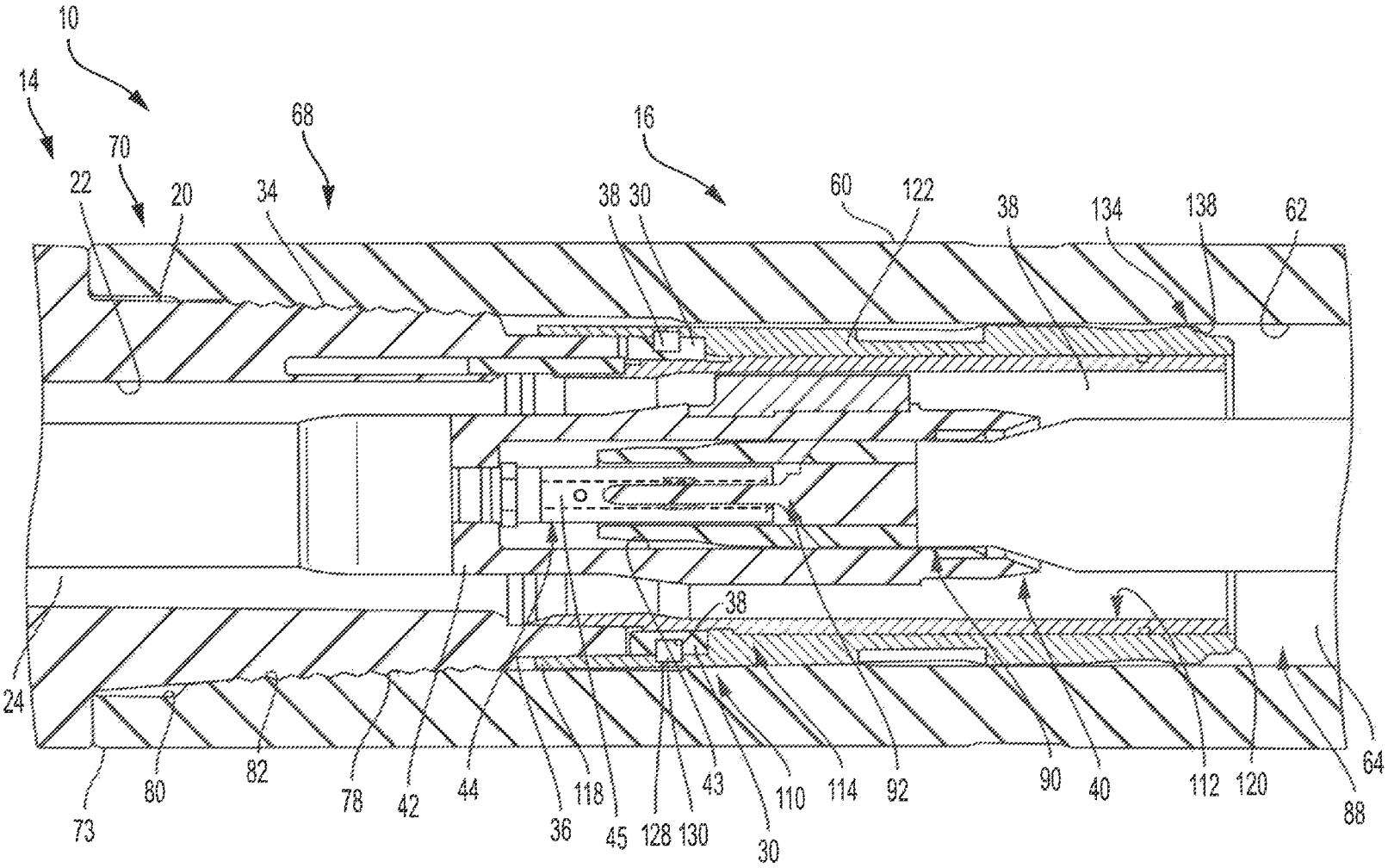
FIG. 4 depicts the system of tubulars of FIG. 4 illustrating the first tubular connected with the second tubular, in accordance with an aspect of an exemplary embodiment.

As pin end 32 is threaded into box end 70 as shown in FIG. 3, the selected amount of misalignment is further reduced to, for example, no more than about 2-degrees due to multiple points of contact between guiding sleeve 110 and inner surface 62. At this point second connector portion 90 extends into guide member 42 to align connector 92 with central recess 45. Once pin end 32 comes together with box end 70, connector 92 is arranged in central recess 45 to provide a connection between conductor 46 and the conductor as shown in FIG. 4. It should be understood that the selected amount of axial misalignment may vary depending upon thread type, connector type and the like.

Set forth below are some embodiments of the foregoing disclosure:

Embodiment 1: A guiding sleeve for aligning downhole tubulars comprising: a body having a first end portion, a second end portion and an intermediate portion extending there between, the first end portion being receptive of a terminal end of a first tubular and the second end portion including a guiding feature that promotes alignment of the first tubular with a second tubular.

Embodiment 2: The guiding sleeve according to any previous embodiment, wherein the guiding feature comprises a projection that extends radially outwardly of the second end portion.

Embodiment 3: The guiding sleeve according to any previous embodiment, wherein the projection extends annularly about the second end portion.

Embodiment 4: The guiding sleeve according to any previous embodiment, wherein the projection includes a generally rounded cross-section.

Embodiment 5: A system of tubulars comprising: a first tubular; a second tubular; and a guiding sleeve connected to the first tubular, the guiding sleeve including a body having a first end portion, a second end portion and an intermediate portion extending there between, the first end portion being connected to the first tubular, the second end portion including a guiding feature that promotes alignment of the first tubular with the second tubular.

Embodiment 6: The system of tubulars according to any previous embodiment, wherein the second tubular comprises a box end having an angled back bore and an inner surface extending from the angled back bore axially inwards along the second tubular, the box end being receptive of the second end portion of the guiding sleeve.

Embodiment 7: The system of tubulars according to any previous embodiment, wherein the second tubular includes a chamfer region on the inner surface, that extends axially along the inner surface and radially inwards.

Embodiment 8: The system of tubulars according to any previous embodiment, wherein the guiding feature comprises a projection that extends radially outwards of the second end portion.

Embodiment 9: The system of tubulars according to any previous embodiment, wherein the projection extends annularly about the second end portion.

Embodiment 10: The system of tubular according to any previous embodiment, wherein the projection includes a generally rounded cross-section.

Embodiment 11: The system of tubulars according to any previous embodiment, wherein the first tubular comprises a first interior including a first connector portion and the second tubular comprises a second interior including a second connector portion, the guiding sleeve promoting alignment of the first connector portion and the second connector portion.

Embodiment 12: The system of tubulars according to any previous embodiment, wherein the first connector portion comprises a first electrical connector portion and the second connector portion comprises a second electrical connector portion.

Embodiment 13: The system of tubulars according to any previous embodiment, wherein the guiding sleeve is formed from a material having a hardness that is less than the hardness of the material of the second tubular.

Embodiment 14: The system of tubulars according to any previous embodiment, wherein the guiding sleeve establishes at least two points of contact with the inner surface of the second tubular.

Embodiment 15: The system of tubulars according to any previous embodiment, wherein the first point of contact is between the guiding feature and the inner surface of the second tubular.

Embodiment 16: The system of tubulars according any previous embodiment, wherein the second point of contact is between the guiding sleeve and the inner surface of the second tubular, at a position on the guiding sleeve that is distal from the guiding feature.

Embodiment 17: The system of tubulars according any previous embodiment, wherein the first point of contact and the second point of contact are 180 degrees apart from one another along the circumference of the guiding sleeve in a cross section perpendicular to the longitudinal axis of the guiding sleeve.

Embodiment 18: A method of making-up a system of tubulars, comprising: providing a first tubular; providing a second tubular with an inner surface; connecting a guiding sleeve to the first tubular, the guiding sleeve including a body having a first end portion, a second end portion and an intermediate portion extending there between, the first end portion being connected to the first tubular, the second end portion including a guiding feature; using the guiding feature to promote alignment of the first tubular with the second tubular.

Embodiment 19: The method any previous embodiment, wherein the guiding sleeve establishes at least two points of contact with the inner surface of the second tubular.

Embodiment 20: The method any previous embodiment, wherein the system of tubulars is made-up at a rig site.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A guiding sleeve for aligning a first terminal end of a first downhole tubular and a second terminal end of a second downhole tubular, the first downhole tubular supporting a first connector portion and the second downhole tubular supporting a second connector portion, the guiding sleeve comprising:

a body having a first end portion coupled to the first terminal end of the first downhole tubular, a second end portion and an intermediate portion extending there between, the second end portion including a guiding feature that projects outwardly of the body, wherein the first connector portion is arranged within the guiding sleeve and the second connector portion is arranged at the second terminal end of the second downhole tubular, and wherein the guiding feature that promotes alignment of the first downhole tubular relative to the second downhole tubular and promotes alignment of the first connector portion with the second connector portion.

2. The guiding sleeve according to claim 1, wherein the first connector portion and the second connector portion form an electrical connector.

3. The guiding sleeve according to claim 1, wherein the guiding feature extends annularly about the second end portion.

4. A guiding sleeve according to claim 1, wherein the second downhole tubular comprises an inner surface, the guiding sleeve establishing at least a first point of contact and a second point of contact with the inner surface of the second downhole tubular, the first point of contact being between the guiding feature and the inner surface of the second downhole tubular, and the second point of contact being between the guiding sleeve and the inner surface of the second downhole tubular, at a position on the guiding sleeve that is distal from the guiding feature along a longitudinal axis of the guiding sleeve.

5. A system of tubulars comprising:

a first tubular including a first terminal end, the first tubular supporting a first connector portion;

a second tubular including a second terminal end, the second tubular supporting a second connector portion; and a guiding sleeve including a body having a first end portion connected to the first terminal end of the first tubular, a second end portion and an intermediate portion extending there between, the first connector portion being arranged within the guiding sleeve, the second end portion of the guiding sleeve including a guiding feature that projects outwardly of the body, the guiding feature promoting alignment of the first tubular relative to the second tubular and promoting alignment of the first connector portion with the second connector portion arranged at the second terminal end of the second tubular.

6. The system of tubulars according to claim 5, wherein the second tubular comprises a box end having an angled back bore and an inner surface extending from the angled back bore axially inwards along the second tubular, the box end being receptive of the second end portion of the guiding sleeve.

7. The system of tubulars according to claim 6, wherein the second tubular includes a chamfer region on the inner surface, that extends axially along the inner surface and radially inwards.

8. The system of tubulars according to claim 5, wherein the guiding feature includes a generally rounded cross-section.

9. The system of tubulars according to claim 5, wherein the first connector portion comprises a first electrical connector portion and the second connector portion comprises a second electrical connector portion.

10. The system of tubulars according to claim 5, wherein the guiding sleeve is formed from a material having a hardness that is less than the hardness of the material of the second tubular.

11. The system of tubulars according to claim 5, wherein the second tubular includes an inner surface, the guiding sleeve establishing at least a first point of contact and a second point of contact with the inner surface of the second tubular, the first point of contact being between the guiding feature and the inner surface of the second tubular.

12. The system of tubulars according to claim 11, wherein the second point of contact is between the guiding sleeve and the inner surface of the second tubular, at a position on the guiding sleeve that is distal from the guiding feature along a longitudinal axis of the guiding sleeve.

13. The system of tubulars according to claim 12, wherein an axial distance along the longitudinal axis of the guiding sleeve between the first point of contact and the second point of contact varies during the alignment of the first tubular relative to the second tubular.

14. The system of tubulars according to claim 11, wherein the first point of contact and the second point of contact are 180 degrees apart from one another along the circumference of the guiding sleeve in a cross section perpendicular to a longitudinal axis of the guiding sleeve.

15. The system of tubulars according to claim 5, wherein the guiding feature extends annularly about the second end portion.

16. The system of tubulars according to claim 5, wherein the second tubular comprises an inner surface, the inner surface including a chamfer region, the chamfer region extending axially along the inner surface and radially inwardly, the guiding sleeve establishing at least a first point of contact and a second point of contact with the inner surface of the second tubular, the first point of contact being between the guiding feature and the inner surface of the second tubular, the second point of contact being at the chamfer region.

17. A method of making-up a system of tubulars, comprising:

providing a first tubular having a first connector portion;

providing a second tubular with an inner surface, the second tubular including a second connector portion;

connecting a guiding sleeve to the first tubular, the guiding sleeve including a body having a first end portion, a second end portion and an intermediate portion extending there between, the first end portion being connected to the first tubular, the second end portion including a guiding feature, the first connector portion being arranged within the guiding sleeve;

promoting alignment of the first connector portion with the second connector portion by shifting the guiding feature along the inner surface of the second tubular.

18. The method of claim 17, wherein the guiding sleeve establishes at least two points of contact with the inner surface of the second tubular.

19. The method of claim 17, wherein promoting alignment of the first connector portion and the second connector portion includes establishing an electrical connection.

20. The method of claim 17, wherein the system of tubulars is made-up at a rig site.

* * * * *